US007941074B2

(12) United States Patent
Nakagaki

(10) Patent No.: US 7,941,074 B2
(45) Date of Patent: May 10, 2011

(54) IMAGE CONVEYANCE UNIT, INTERMEDIATE TRANSFER UNIT, ELECTROSTATIC TRANSFER UNIT, AND IMAGE FORMING APPARATUS

(75) Inventor: Jun Nakagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/478,653

(22) Filed: Jun. 4, 2009

(65) Prior Publication Data

US 2009/0304426 A1 Dec. 10, 2009

(30) Foreign Application Priority Data

Jun. 6, 2008 (JP) ..... 2008-149369

(51) Int. Cl.
*G03G 15/16* (2006.01)

(52) U.S. Cl. ..... 399/121; 399/302

(58) Field of Classification Search ..... 399/121, 399/110, 302, 308, 124, 316
See application file for complete search history.

(56) References Cited

U.S. PATENT DOCUMENTS 5,787,326 A * 7/1998 Ogawa et al. ..... 399/124
5,991,570 A * 11/1999 Haga et al. ..... 399/114

FOREIGN PATENT DOCUMENTS

JP 06-202404 A * 7/1994
JP 2004-318003 11/2004

* cited by examiner

*Primary Examiner* — Sophia S Chen
(74) *Attorney, Agent, or Firm* — Canon USA Inc IP Division

(57) ABSTRACT

A belt cover is configured to approach an intermediate transfer belt when an intermediate transfer portion retracts from a photosensitive drum. This allows the space required for the retraction of the belt cover to be made smaller when the intermediate transfer portion retracts from the photosensitive drum. Therefore, a color printer body can be made more compact.

14 Claims, 16 Drawing Sheets

IMAGE CONVEYANCE UNIT, INTERMEDIATE TRANSFER UNIT, ELECTROSTATIC TRANSFER UNIT, AND IMAGE FORMING APPARATUS

BACKGROUND OF THE INVENTION

1. Field of the Invention

The present invention relates generally to a unit that includes an image conveyance member or an electrostatic transfer member. Further, the present invention relates to an image forming apparatus, which includes the unit, such as a copying machine, a facsimile machine, a printer, or a multi-function peripheral (MFP) including these functions.

2. Description of the Related Art

Conventionally, image forming apparatuses have been commercially produced in which a toner image formed on a photosensitive member is transferred onto a recording material via an intermediate transfer member. However, the intermediate transfer member can deteriorate if it is directly touched by a user. Therefore, it has been necessary to protect the intermediate transfer member from a touch by a user on the intermediate transfer member. Such a case can occur when the paper in the image forming apparatus jams, for example.

Accordingly, Japanese Patent Application Laid-Open No. 2004-318003 discusses an apparatus in which a protective cover is provided to protect an intermediate transfer belt. In the apparatus discussed in Japanese Patent Application Laid-Open No. 2004-318003, the intermediate transfer portion can retract so that the intermediate transfer member separates from the photosensitive member. The protective cover is fixed facing a surface on the side where the intermediate transfer member retracts from the photosensitive member. Accordingly, the intermediate transfer portion can be removed by the user when the intermediate transfer portion is retracted from the photosensitive member.

However, in the apparatus discussed in Japanese Patent Application Laid-Open No. 2004-318003, the protective cover is immovably fixed to the intermediate transfer portion. Therefore, there still is room for improving the space utilization efficiency of the image forming apparatus. In other words, the image forming apparatus can be made more compact. The apparatus discussed in Japanese Patent Application Laid-Open No. 2004-318003 is configured so that the intermediate transfer belt and the protective cover both retract from the photosensitive member by the same distance. Thus, the space required for this protective cover retraction also has to be secured.

Therefore, in the apparatus discussed in Japanese Patent Application Laid-Open No. 2004-318003, a recording material conveying mechanism located near the intermediate transfer portion must be arranged so that the protective cover does not contact the recording material conveying mechanism when the protective cover is retracted. Namely, the space required for protective cover retraction has to be sufficiently prepared beforehand.

Thus, in a configuration in which the protective cover is immovably fixed to the intermediate transfer portion, the space required for protective cover retraction is increased. Therefore, space utilization efficiency in the image forming apparatus is low.

This problem can also arise for a photosensitive unit which conveys the toner image to the transfer portion using a photosensitive member. That is, if the protective cover for protecting the photosensitive member is immovably fixed, similarly, the space utilization efficiency in the image forming apparatus is decreased. Hereinafter, the intermediate transfer member and the photosensitive member may also be referred to as "image conveyance member", and the intermediate transfer portion and the photosensitive unit may also be referred to as "image conveyance unit".

SUMMARY OF THE INVENTION

The present invention is directed to decreasing the size of the space required for protective cover retraction when an image conveyance unit is retracted from an image forming device. Further, the present invention is directed to providing an image conveyance unit that can be freely detached from and mounted into an image forming apparatus having an image forming device for forming a toner image.

According to an aspect of the present invention, an image forming apparatus includes an image forming device configured to form a toner image, and an image conveyance unit configured to be moved between an image forming position of the image forming device and a retracting position retracted from the image forming device, which is different from the image forming position, and configured to be removable from the image forming apparatus. The image conveyance unit includes an image conveyance member configured to convey a toner image formed by the image forming device to a transfer portion which transfers the toner image onto a recording material, a protective cover configured to protect a surface of the image conveyance member on which the toner image is formed, and a support unit configured to movably support the protective cover so that the protective cover approaches the image conveyance member when the image conveyance unit retracts from the image forming position to the retracting position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 2:
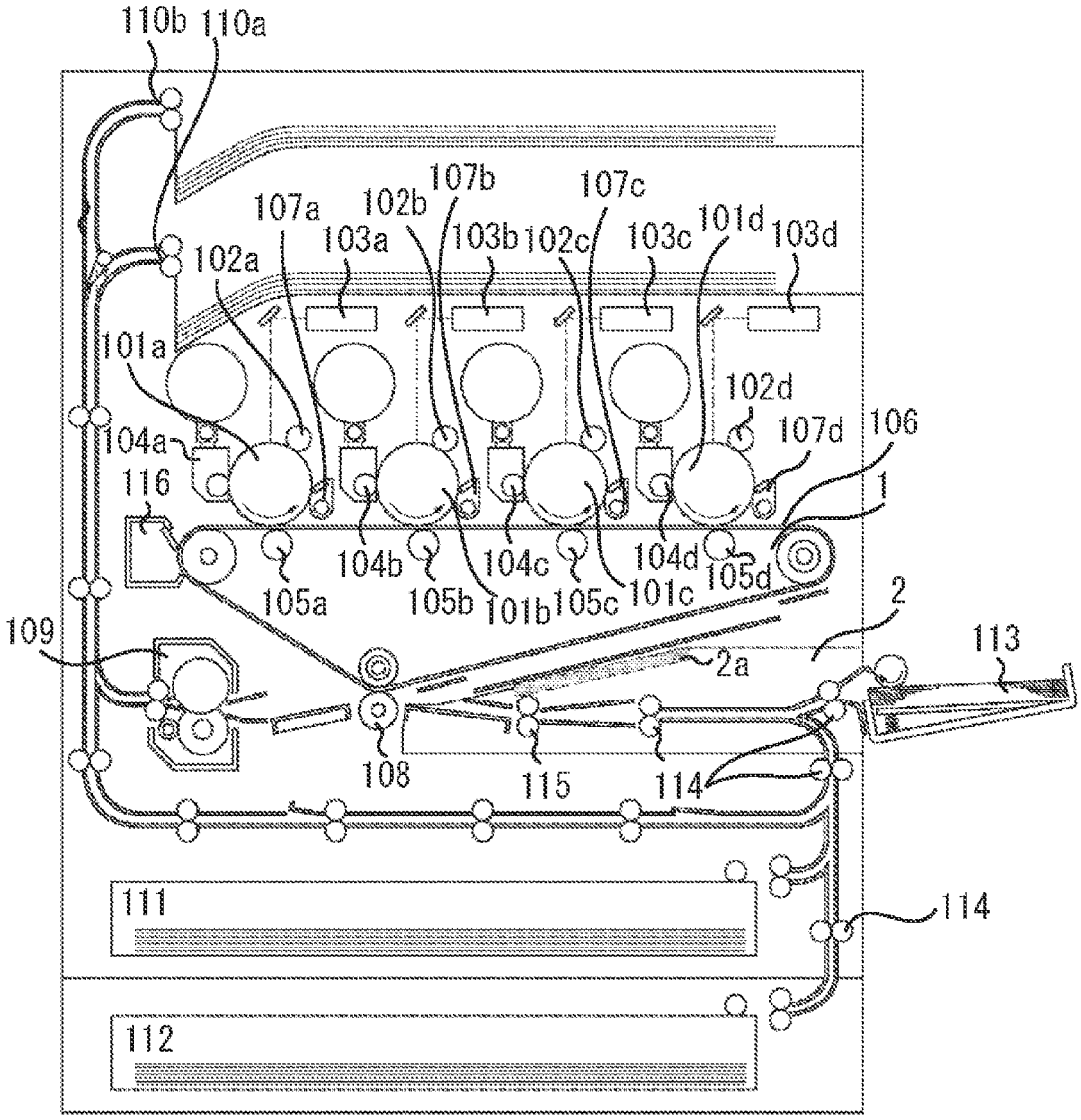
FIG. 2 illustrates an example of a schematic configuration of the color printer body according to the first exemplary embodiment of the present invention.

A first exemplary embodiment will now be described. FIG. 2 is illustrates an intermediate transfer method tandem type color printer, which is an example of an image forming apparatus. In the present exemplary embodiment, an intermediate transfer belt is used as the intermediate transfer member. The configuration of a color printer will now be described following a flow in which the color printer forms an image on a recording medium such as paper, and then fixes the image.

An image forming device includes a photosensitive drum, a charging roller, a laser scanner, and a developing unit. First, the process for forming a yellow toner image will be described. The surface of a photosensitive drum 101*a* is charged with a uniform potential by a charging roller 102*a*. Next, a yellow image signal is input into a laser scanner 103*a*. The laser scanner 103*a* irradiates a laser beam on the surface of the photosensitive drum 101*a* according to the input image signal. As a result, the electric charge on the surface of the photosensitive drum 101*a* is neutralized, and an electrostatic latent image is formed on the surface of the photosensitive drum 101*a*.

Next, the electrostatic latent image formed on the surface of the photosensitive drum 101*a* is developed with the yellow toner by a developing unit 104*a*. The yellow toner image developed on the photosensitive drum 101*a* then undergoes primary transfer to an intermediate transfer belt 106 (image conveyance unit) by a primary transfer roller 105*a*.

Magenta, cyan, and black toner images similarly developed on photosensitive drums 101*b* to 101*d* undergo primary transfer to the intermediate transfer belt 106 in the similar manner as yellow, i.e., the surfaces of the photosensitive drums 101*b-d* are charged with a uniform potential by charging rollers 102*b-d*, laser scanners 103*b-d* irradiate laser beams on the surfaces of the photosensitive drums 101*b-d* according to input image signals, and the electrostatic latent images formed on the surfaces of the photosensitive drums 101*b-d* are developed with toners by developing units 104*b-d*, respectively. As a result, yellow, magenta, cyan, and black toner images are formed on the intermediate transfer belt, and these toner images are conveyed to a secondary transfer portion (the transfer portion).

Residual transfer toner on each of the photosensitive drums 101 that is not transferred to the intermediate transfer belt is collected by drum cleaners 107*a* to 107*d* respectively corresponding to the photosensitive drums 101.

On the other hand, the recording material such as paper is fed from any of a cassette 111, a cassette 112, or a manual feed tray 113. A conveyance unit 2 (a recording material conveyance unit) has the manual feed tray 113, a conveying roller 114, and a registration roller 115.

The recording material fed by the conveying roller butts the stationary registration roller, which causes the registration roller to rotate. The recording material is thereby conveyed to the secondary transfer portion by the registration roller that rotates in synchronization with the toner image on the intermediate transfer belt.

The toner image conveyed to the secondary transfer portion by the intermediate transfer belt is transferred onto the recording material, which is fed to the secondary transfer portion by the registration roller 115, by applying a transfer bias to a secondary transfer roller 108. Then, the toner image transferred onto the recording material is fixed on the recording material by heat and pressure from a fixing device 109 (a fixing unit). The recording material on which the toner image is fixed is then discharged from either a sheet discharge unit 110*a* or a sheet discharge unit 110*b* to a sheet discharge tray.

Residual toner on the intermediate transfer belt which has not been transferred onto the recording material by the secondary transfer portion is collected by an intermediate transfer belt cleaner 116.

Next, the positional relationship among the respective units of the color printer in the present exemplary embodiment will be described. In the present exemplary embodiment, the positional relationship between an intermediate transfer portion 1 (image conveyance unit) including the intermediate transfer belt and the other units is important. As illustrated in FIG. 2, photosensitive drums 101*a* to 101*d* are arranged in an upper side of the intermediate transfer portion 1. Further, the conveyance unit 2 (recording material conveyance unit) is arranged in a lower side of the intermediate transfer portion 1. Unless indicated otherwise, the downward direction on the paper surface is the direction of gravity.

Figure 1:
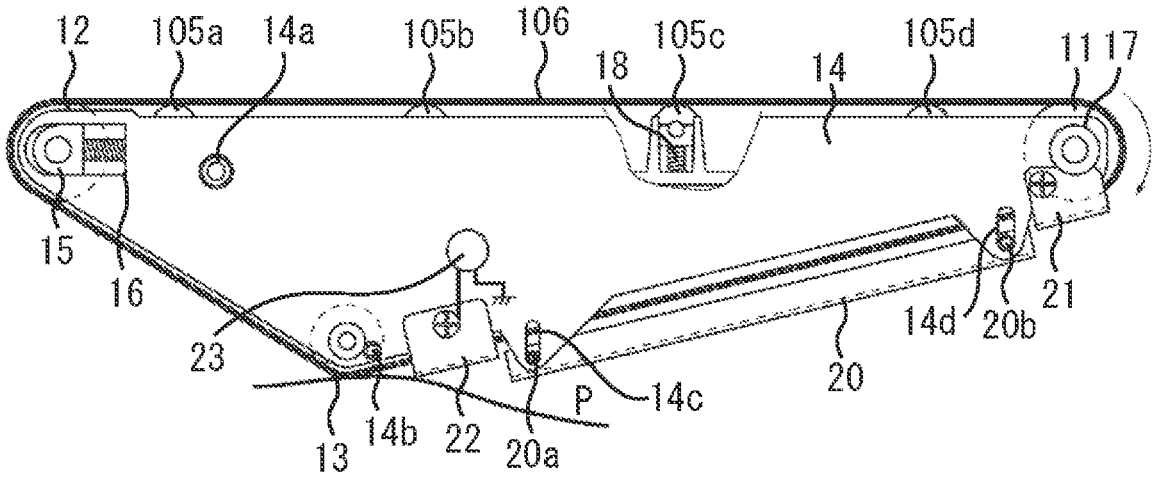
FIG. 1 illustrates an example of a schematic configuration of an intermediate transfer portion housed in a color printer body according to a first exemplary embodiment of the present invention.

The configuration of the intermediate transfer portion 1 housed in the color printer illustrated in FIG. 1 will now be described. FIG. 1 illustrates an intermediate transfer portion 1 housed in the color printer according to the first exemplary embodiment. First, an intermediate transfer belt holding mechanism of the intermediate transfer portion 1 will be described, and then the parts of the intermediate transfer portion 1 which are supported so as to roll along a rail of the color printer body will be described. Lastly, the configuration of a cover of the intermediate transfer belt, which is a characteristic feature of the present exemplary embodiment, will be described.

The intermediate transfer belt holding mechanism in the intermediate transfer portion 1 will now be described. The intermediate transfer belt 106 is stretched around three stretching rollers, such as a drive roller 11, a tension roller 12, and a secondary transfer inner roller 13. These three rollers are grounded.

The drive roller 11 and the secondary transfer inner roller 13 are rotatably supported on a frame 14 of the intermediate transfer portion 1. Both end vicinities of the tension roller 12 are rotatably supported on the frame 14 by a bearing 15 which can move in a horizontal direction on the paper surface of FIG. 1. Further, the bearing 15 is urged to the left direction on the paper of FIG. 1 by a spring 16. Therefore, even if the length of the intermediate transfer belt and the dimensions of the other parts vary in their dimensional tolerance, the intermediate transfer belt is stretched by a tensile force that is almost constant.

By rotating the drive roller 11 in a clockwise direction on the paper surface in FIG. 1, the intermediate transfer belt 106 also rotates in the clockwise direction. The tension roller 12 and the secondary transfer inner roller 13 are driven to be rotated by the rotation of the intermediate transfer belt 106.

Next, the parts of the intermediate transfer portion 1 which are supported rotatably along the rail of the color printer body will be described. A bearing 17 is attached to either end of the drive roller 11. Further, a boss 14*a* protrudes toward the front side in FIG. 1 from the frame 14, and the boss 14*a* similarly protrudes from the rear side of the frame. The color printer body supports the intermediate transfer portion 1 with the bearing 17 and the boss 14*a* as support points, while also positioning the intermediate transfer portion 1 with the bearing 17 and the boss 14*a* to be used as a reference.

Further, a pin 14*b* for positioning the intermediate transfer portion 1 protrudes toward the front side in FIG. 1 from the frame 14, and a pin 14*b* similarly protrudes from the rear side of the frame. Further, primary transfer rollers 105*a* to 105*d* are arranged on an inner side of the intermediate transfer belt 106 that is stretched around the drive roller 11 and the tension roller 12. The primary transfer roller 105*c* is urged in an upward direction on the paper surface in FIG. 1 by a spring 18.

The primary transfer rollers 105*a*, 105*b*, and 105*d* other than primary transfer roller 105*c* are similarly urged in an upward direction by springs (not illustrated). As a result, when the intermediate transfer portion 1 is ready for image forming in the color printer, the primary transfer rollers 105*a* to 105*d* urge the intermediate transfer belt 106 in an upward direction in FIG. 1, so that the intermediate transfer belt 106 is pressed against the photosensitive drums 101*a* to 101*d*. The intermediate transfer portion 1 is thus formed.

Lastly, the configuration of the cover of the intermediate transfer belt will be described. Conventionally, when the cover of the intermediate transfer belt 106 is fixed, the cover is configured from one plate. However, in the present exemplary embodiment, the cover of the intermediate transfer belt is divided into three respectively adjacent parts. A belt cover 20 as a protective cover, an electric potential regulator 21 as a facing cover, and a pre-transfer guide 22 as a guiding cover are attached facing an outer circumference surface of the intermediate transfer belt 106 which is stretched by the drive roller 11 and the secondary transfer inner roller 13.

The electric potential regulator 21 and the pre-transfer guide 22 are fixed to the frame 14 so as to be approximately parallel to the facing intermediate transfer belt 106, and so that each of them has a distance of about 3 to 5 mm from the intermediate transfer belt 106. Further, the electric potential regulator 21 and the pre-transfer guide 22 protect the intermediate transfer belt 106 from being touched by the user.

Next, the moving mechanism of the belt cover 20 will be described in detail. Then, the electric potential regulator 21 and the pre-transfer guide 22 will be described.

In the present exemplary embodiment, as is described below, the belt cover 20 is movably supported so as to approach the intermediate transfer belt 106 when the intermediate transfer portion 1 is separated from the photosensitive drums. The moving direction when the intermediate transfer portion 1 contacts or separates from the photosensitive drums has a direction component of the direction that the belt cover 20 is moving. This allows the size of the whole color printer to be made smaller. A mechanism for varying the distance between the intermediate transfer belt 106 and the belt cover 20 will be described. The belt cover 20 is arranged facing the intermediate transfer belt 106 to protect the intermediate transfer member from being touched by the user.

The guide pins 20*a* and 20*b* which are fixed to the belt cover 20 are fitted into guide grooves 14*c* and 14*d* as a support unit formed on the frame 14. Namely, the belt cover 20 is not fixed to the frame 14, and therefore can move along the guide grooves 14*c* and 14*d*.

The guide grooves 14*c* and 14*d* are arranged in a downward direction on the paper surface in FIG. 1. Thus, the belt cover 20 can move in a downward direction on the paper surface in FIG. 1. Namely, the belt cover 20 can vary the distance from the surface of the facing intermediate transfer belt 106. When the guide pins 20*a* and 20*b* of the belt cover 20 are at a position on the bottom edge of the guide grooves 14*c* and 14*d* of the frame, the distance between the intermediate transfer belt 106 and the belt cover 20 is about 8 to 15 mm.

On the other hand, when the guide pins 20*a* and 20*b* of the belt cover 20 are at a position on the top edge of the guide grooves 14*c* and 14*d* of the frame, the distance between the intermediate transfer belt 106 and the belt cover 20 is about 3 to 5 mm. This distance between the intermediate transfer belt 106 and the belt cover 20 is determined including a deflection amount of the intermediate transfer belt 106 when forming an image. Thus, this distance may be changed based on the rotation speed of the intermediate transfer belt 106 and the like.

Further, in the present exemplary embodiment, the belt cover 20 is made of an electrogalvanized steel plate as a conductor, and is grounded so that the intermediate transfer belt 106 is not electrically charged. Thus, this distance between the intermediate transfer belt 106 and the belt cover 20 is desirably changed to a distance considering that the intermediate transfer belt 106 is attracted toward the belt cover 20 due to an electrical force. Further, if a vibration occurs, as the belt cover 20 is not urged by a spring in a direction away from the intermediate transfer belt 106, the belt cover 20 can be easily moved.

When replacing the intermediate transfer portion 1, the intermediate transfer portion 1 is separated not to damage the photosensitive drums 101 and the surface of the intermediate transfer belt 106. This action will now be described while comparing the intermediate transfer portion 1 mechanisms illustrated in FIGS. 3 and 4. In the action, the belt cover 20 moves so that the space taken up by the intermediate transfer portion 1 is decreased by making the conveyance unit 2 of the color printer body and the belt cover 20 of the intermediate transfer portion 1 contact each other.

An arm 33 is attached to the color printer body so as to rotate around a rotating shaft 33*a*. To rotate the arm 33, an operation lever 33*b*, which allows the user to apply a rotation force on the rotating shaft 33*a*, is attached to the rotating shaft 33*a*. When the user operates the operation lever 33*b* in a clockwise direction R on the paper surface in FIG. 3, the intermediate transfer portion 1 becomes the state as illustrated in FIG. 4. This operation retracts the intermediate transfer portion 1 from the photosensitive member. As a result, the intermediate transfer portion 1 moves to a retracting position where the intermediate transfer belt 106 and the photosensitive member are not in contact with each other.

Figure 3:
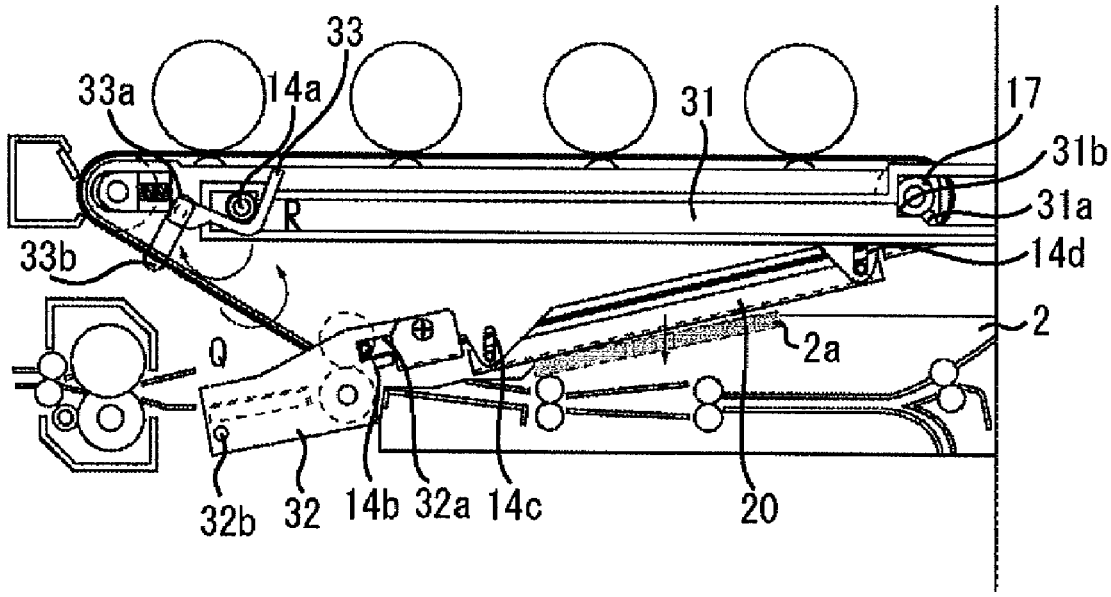
FIG. 3 illustrates an example of a state in which the intermediate transfer portion and photosensitive drums are pressed according to the first exemplary embodiment of the present invention.
Figure 4:
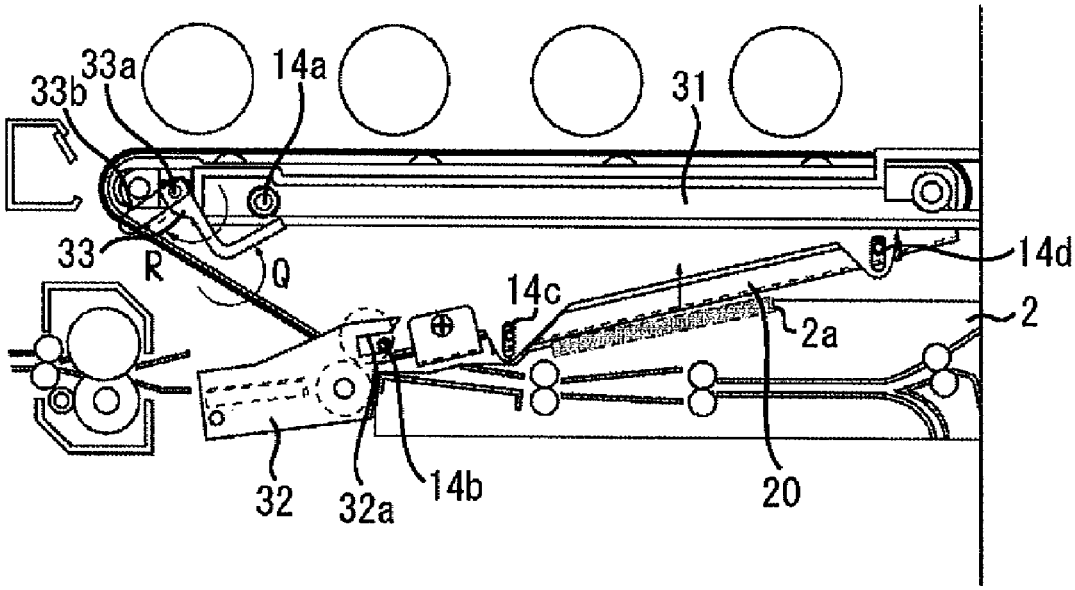
FIG. 4 illustrates an example of a state in which the intermediate transfer portion and the photosensitive drums are separated according to the first exemplary embodiment of the present invention.

Similarly, when the user operates the operation lever 33*b* in a counterclockwise direction Q on the paper surface in FIG. 4, the intermediate transfer portion 1 becomes the state as illustrated in FIG. 3. By this operation, the intermediate transfer portion 1 is brought into contact with the photosensitive member. As a result, the intermediate transfer portion 1 moves to an image forming position where the intermediate transfer belt 106 and the photosensitive member are in contact with each other to form an image. Thus, in the present exemplary embodiment, the moving unit for moving the protective cover includes a mechanism that supports the protective cover by grooves and bosses, and a conveyance unit 2 having a contact portion.

The belt cover 20 is arranged without being urged by a spring in a movable direction. Thus, the belt cover 20 can easily move by the contact between an inclined face 2*a* of an outside upper portion (contact portion) of the conveyance unit 2. Therefore, the distance between the belt cover 20 and the intermediate transfer belt 106 can easily fluctuate. Therefore, the electric potential regulator 21 and pre-transfer guide 22, which preferably maintain the desired distance, are fixed to the frame of the intermediate transfer portion body and are separated from the belt cover 20.

FIG. 3 illustrates a state where an image can be formed by an intermediate transfer portion 1 that contacts a photosensitive drum. In the state illustrated in FIG. 3, the distance between the intermediate transfer belt 106 and the belt cover 20 is about 8 to 15 mm. The configuration which moves the belt cover 20 will now be described.

In FIG. 4, the arm 33 rotates counterclockwise around the rotating shaft by operating the operation lever 33*b* counterclockwise as illustrated by Q. As a result, the arm 33 catches the boss 14*a* of the frame, and the boss abuts the upper surface of a rail 31. Further, the bearings 17 arranged on either end of the drive roller moves up an incline 31*a* of the rail and fit into a groove 31*b*.

Then, the belt cover 20 pushed up by the inclined face 2*a* of the outside upper portion of the conveyance unit 2 descends along the guide grooves 14*c* and 14*d* of the frame by its own weight, so that the distance between the intermediate transfer belt 106 and the belt cover 20 becomes about 8 to 15 mm. Further, at this stage, since the pin 14*b* of the frame of the intermediate transfer portion 1 is fitted into the groove 32*a* of the secondary transfer portion 32, the secondary transfer portion 32 rotates counterclockwise around a rotating shaft 32*b* and is lifted up to be the state illustrated in FIG. 3.

FIG. 4 is illustrates an example of a state where the intermediate transfer portion 1 is retracted away from the photosensitive drums 101. In the state illustrated in FIG. 4, the distance between the intermediate transfer belt 106 and the belt cover 20 is about 3 to 8 mm.

In FIG. 3, the arm 33 rotates in a clockwise direction around the rotating shaft by operating the operation lever 33*b* in the clockwise direction R on the paper surface. As a result, the arm releases the boss 14*a* of the frame, and the boss 14*a* of the frame of the intermediate transfer portion 1 changes from a state of abutting the upper surface of the rail 31 to a state of riding on a lower surface of the rail.

Further, the bearings 17 arranged on either end of the drive roller move down the incline 31*a* of the rail, to change the state to a state of riding on a lower surface of the rail. Here, as illustrated in FIG. 3, the belt cover 20 changes from a state of abutting the lower face of the guide grooves 14*c* and 14*d* of the frame of the intermediate transfer portion 1 by its own weight to being comparatively raised with respect to the frame by abutting the inclined face 2*a* of the outside upper portion of the conveyance unit 2. As a result, the distance between the belt cover 20 and the intermediate transfer belt 106 is about 3 to 5 mm.

By thus configuring the intermediate transfer portion 1, the distance between the belt cover 20 when the photosensitive drums 101 are separated from the intermediate transfer portion 1 and the intermediate transfer portion 1 can be about 3 to 5 mm. Therefore, the position of the conveyance unit 2 can be arranged closer to the intermediate transfer portion 1 than the position of the conventional conveyance unit. As a result, the color printer body can be made more compact.

Figure 5:
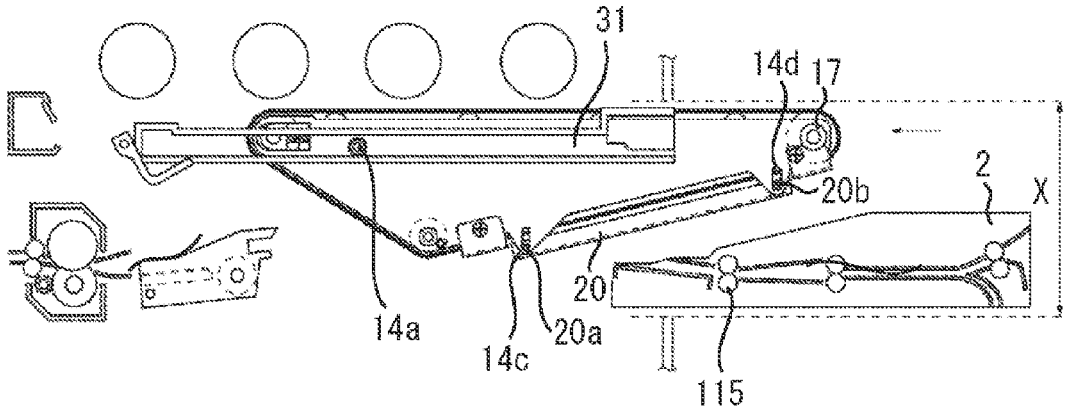
FIG. 5 illustrates an example of a positional relationship between the intermediate transfer portion and the color printer body according to the first exemplary embodiment of the present invention.

In the state illustrated in FIG. 4, if the intermediate transfer portion 1 and the conveyance unit 2 are detached from the color printer body, the resultant state looks like that illustrated in FIG. 5. Further, in the state illustrated in FIG. 5, if the intermediate transfer portion 1 and the conveyance unit 2 are inserted into the color printer body, the resultant state looks like that illustrated in FIG. 4.

Figure 7:
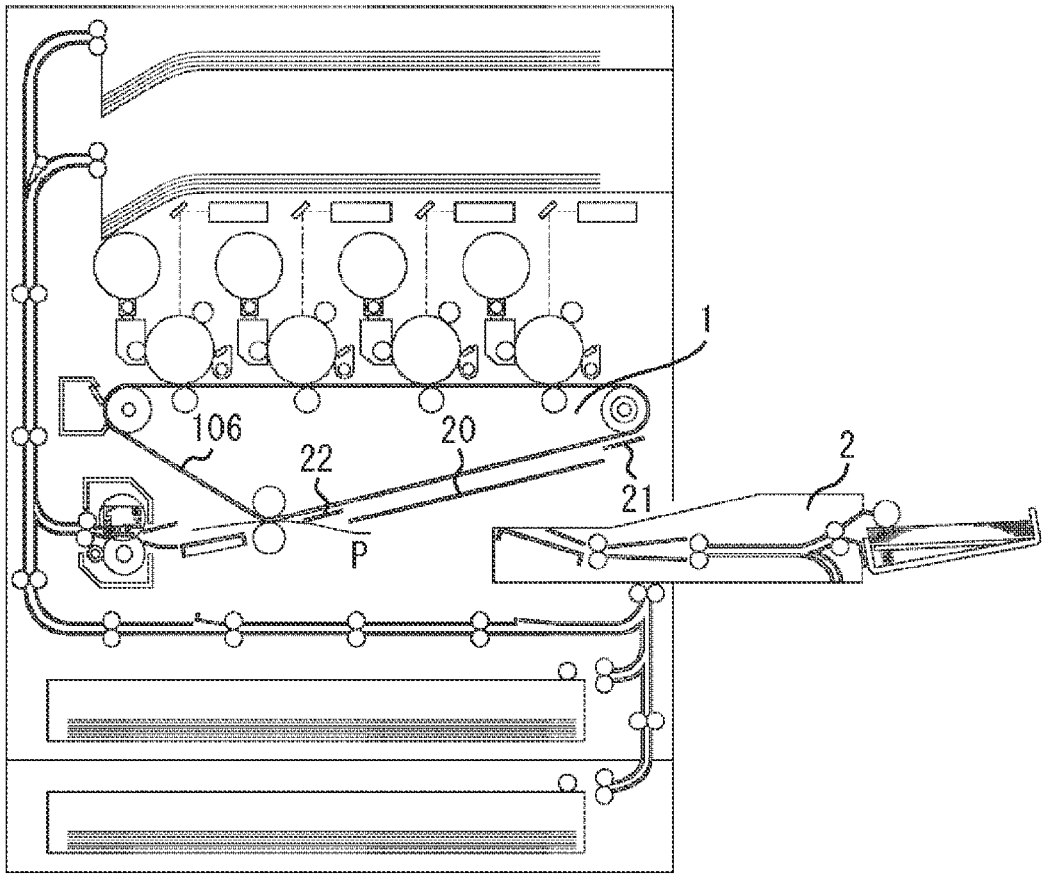
FIG. 7 illustrates an example of a schematic configuration of the intermediate transfer portion housed in the color printer body according to the first exemplary embodiment of the present invention.

As illustrated in FIG. 7, if a jam occurs near the secondary transfer portion, the user pulls out the conveyance unit 2, puts the user's hand near the intermediate transfer portion 1, and removes the jammed sheet of paper P. Further, if a part in the intermediate transfer portion 1 is worn out and needs to be replaced, the intermediate transfer portion 1 has to be pulled out. Therefore, the intermediate transfer portion 1 is designed so as to be detachable from the printer body.

The conveyance unit 2, which includes the registration roller 115 and the like, can be pulled out in a right direction of the color printer body. Further, the intermediate transfer portion 1 can be guided by the rails fixed on either side of the color printer body and can be moved in a horizontal direction on the paper surface in FIG. 5.

The distance between the intermediate transfer portion belt cover 20 and the intermediate transfer belt when detaching or inserting the intermediate transfer portion 1 from/into the printer body changes depending on the positional relationship with the conveyance unit 2. Namely, when the belt cover 20 and the inclined face 2*a* of the outside upper portion of the conveyance unit 2 are in contact with each other, the distance between the belt cover 20 and the intermediate transfer belt is about 3 to 5 mm. When the belt cover 20 and the inclined face 2*a* of the outer contour upper portion of the conveyance unit 2 are not in contact with each other, the distance between the belt cover 20 and the intermediate transfer belt is about 8 to 15 mm.

However, the distance from the upper surface of the intermediate transfer portion 1 to the lower face of the conveyance unit 2 when detaching or inserting the intermediate transfer portion 1 from/into the printer body is constant and does not depend on the distance between the belt cover 20 and the intermediate transfer belt. Further, as described above, since the belt cover 20 is movable, the distance from the upper face of the intermediate transfer portion 1 to the lower face of the conveyance unit 2 can be made smaller than the conventional distance. Namely, the aperture X when detaching or inserting the intermediate transfer portion 1 of the printer body and the conveyance unit 2 in FIG. 5 can be made narrower. As a result, the rigidity of the printer body can be improved.

If a vibration occurs without the belt cover 20 being urged by a spring in a movable direction thereof, the belt cover 20 can be easily moved. Thus, if a vibration occurs, the distance between the belt cover 20 and the intermediate transfer belt can easily fluctuate. However, due to reasons described below, it is desirable that the electric potential regulator and the pre-transfer guide maintain a constant distance with the intermediate transfer belt. The electric potential regulator and the pre-transfer guide are thus separated from the belt cover 20 and fixed to the frame of the intermediate transfer portion body.

The electric potential regulator is fixed to the frame of the intermediate transfer portion at a distance of about 3 to 5 mm from the intermediate transfer belt.

Figure 6:
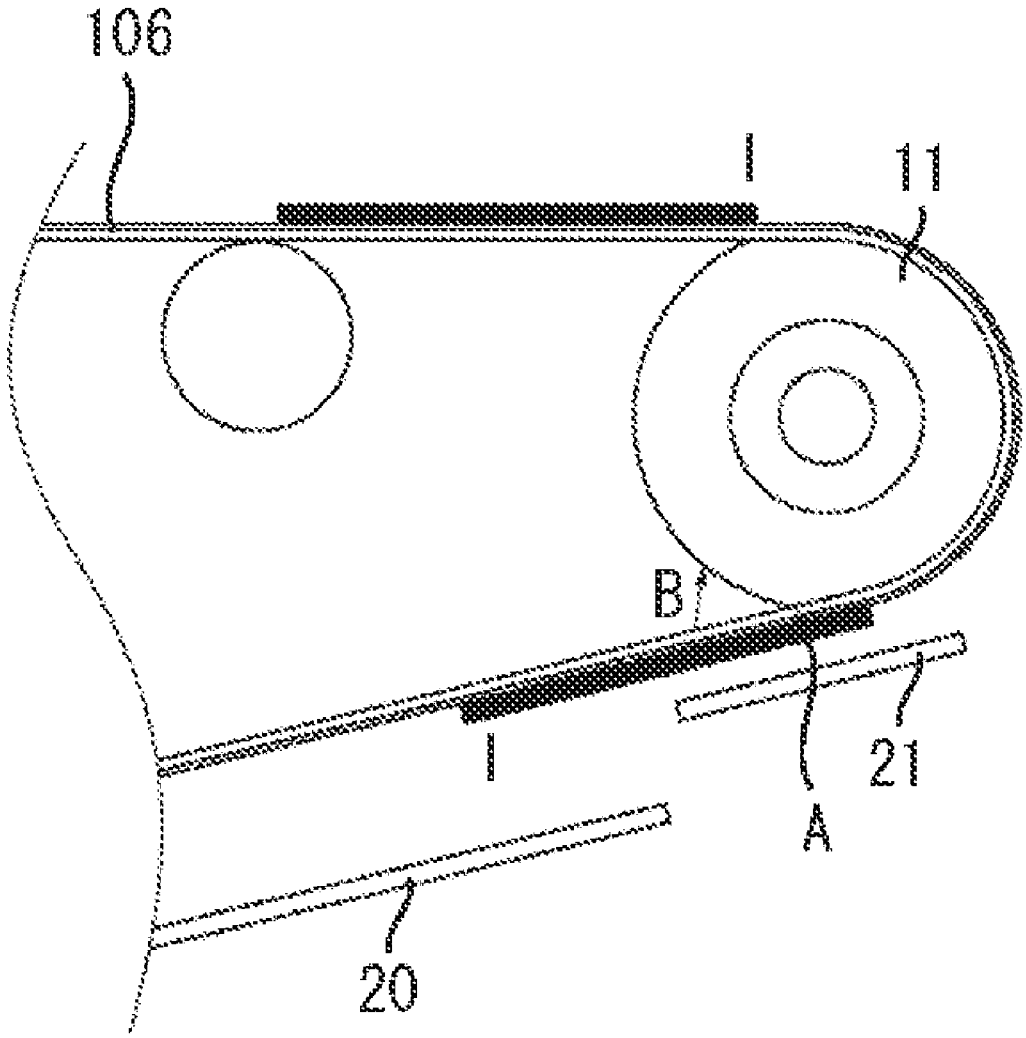
FIG. 6 is a cross sectional diagram illustrating an example of a portion of the intermediate transfer portion near a drive roller according to the first exemplary embodiment of the present invention.

FIG. 6 is a cross sectional diagram illustrating an example of the intermediate transfer portion near a drive roller illustrated in FIG. 1. If there is no electric potential regulator, or the electric potential regulator 21 is located far away from the intermediate transfer belt 106, a separating discharge illustrated by arrow B can be generated from the intermediate transfer belt 106 toward the drive roller which is connected to ground, on the downstream side from a point (point A in FIG. 6) where the intermediate transfer belt 106 is separated from the drive roller 11.

This position of the intermediate transfer belt 106 lies between the primary transfer portion and the secondary transfer portion, and a toner image I is formed on the intermediate transfer belt 106. Therefore, if a separating discharge is generated, the toner image I on the intermediate transfer belt 106 scatters, which can cause an image defect. Therefore, the electric potential regulator 21 is formed by an electrogalvanized steel plate as a conductor, and is connected to the ground that has the same electric potential as the drive roller 11.

Thus, since positions having approximately the same distance from the front and back surface of the intermediate transfer belt 106 have the same electric potential, the separating discharge does not occur so easily. Thus, image defects can be prevented. Further, to prevent image defects, the electric potential regulator 21 can be fixed at a suitable distance from the intermediate transfer belt 106 according to the electric potential of the intermediate transfer belt 106. Therefore, this distance is not limited to that described above.

Since the pre-transfer guide 22 guides the recording material to the secondary transfer portion, the pre-transfer guide 22 is fixed to the frame of the intermediate transfer portion 1 at a distance of about 3 to 5 mm from the intermediate transfer belt 106.

The pre-transfer guide 22 acts as a cover for protecting the intermediate transfer belt 106. Further, the pre-transfer guide 22 also acts as a guide member for feeding the recording material conveyed by the registration roller 115 to the secondary transfer portion. Therefore, the pre-transfer guide 22 is fixed to the frame at a distance of about 3 to 5 mm from the secondary transfer inner roller 13.

Here, if the pre-transfer guide 22 is arranged on the frame without urging by a spring, a vibration may occur caused by collisions with the sheet of paper. As a result, there is a possibility that the recording material cannot be correctly guided to the secondary transfer portion. Therefore, the pre-transfer guide 22 is fixed to the frame 14.

The pre-transfer guide 22 is made of a stainless steel plate as a conductor, and is connected to the ground via a varistor 23. The reason for interposing the varistor 23 is, as illustrated in FIG. 1, because the recording material also in contacts the pre-transfer guide 22 when performing the secondary transfer from the intermediate transfer belt 106 onto the recording material by the secondary transfer portion. If the pre-transfer guide 22 is connected to the ground without interposing a varistor, the bias voltage applied at the secondary transfer portion flows through the recording material to the pre-transfer guide 22, which can cause a transfer defect.

To suitably guide the recording material such as paper to the secondary transfer portion, the pre-transfer guide 22 may be fixed in a suitable range. This distance is not limited to that described above. In the exemplary embodiments, although the materials for the pre-transfer guide 22, the electric potential regulator 21, and the belt cover 20 are specifically described, the present invention is not limited to these materials. Further, while the distances between the belt cover 20 and the intermediate transfer belt 106 were specifically described, the present invention is obviously not limited to such distances.

The first exemplary embodiment is characterized by arranging the belt cover 20 which protects the intermediate transfer belt 106 so as to move parallel to the intermediate transfer belt 106. In a second exemplary embodiment, one end of the belt cover 20 for protecting the intermediate transfer belt is held by a shaft to the frame, and the other end is relatable along a guide groove arranged on the frame. While the mechanism for movably supporting the belt cover 20 is different from that of the first exemplary embodiment, like the first exemplary embodiment, the space which is taken up by the intermediate transfer portion 1 can be decreased compared with the intermediate transfer portion 1 which is immovably fixed to the belt cover 20. Further, parts similar to those in the first exemplary embodiment are denoted with the same reference numerals, and thus a description thereof is omitted.

Except for the intermediate transfer portion 1, the apparatus configuration is similar to that in the first exemplary embodiment. Thus, a description of the similarly configured parts is omitted.

Figure 8:
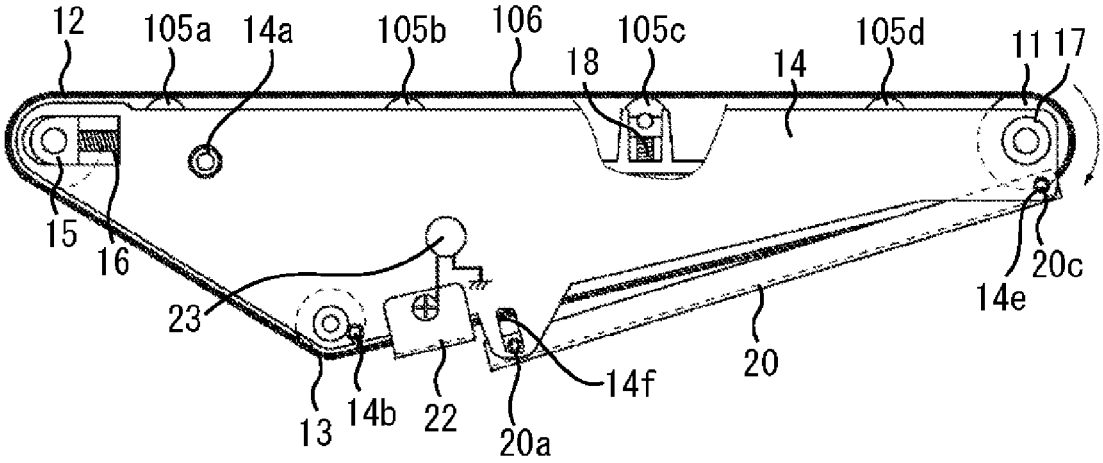
FIG. 8 illustrates an example of a schematic configuration of the intermediate transfer portion housed in the color printer body according to a second exemplary embodiment of the present invention.

FIG. 8 is illustrates an intermediate transfer portion of the second exemplary embodiment. The intermediate transfer belt holding mechanism of the intermediate transfer portion 1 and the parts of the intermediate transfer portion 1 supported so as to roll along a rail of the color printer body have similar configurations to those of the first exemplary embodiment.

The cover of the intermediate transfer belt 106 which has a different configuration to that of the first exemplary embodiment will now be described. In the first exemplary embodiment, the cover of the intermediate transfer belt 106 is divided into three parts. In the second exemplary embodiment, the cover of the intermediate transfer belt 106 is divided into two parts.

The cover of the intermediate transfer belt 106 divided into two parts includes the belt cover 20 as a protective cover and the pre-transfer guide 22 as a guiding cover. The belt cover 20 is arranged facing the outer circumference surface of the intermediate transfer belt 106 that is stretched around the drive roller 11 and the secondary transfer inner roller 13.

As illustrated in the first exemplary embodiment, the pre-transfer guide 22 is fixed to the frame 14 approximately parallel with the facing intermediate transfer belt 106, at a distance of about 3 to 5 mm from the intermediate transfer belt 106. The pre-transfer guide 22 has the same configuration as described in the first exemplary embodiment, and thus a further description thereof is omitted here.

The belt cover 20 is rotatably disposed on the frame body. Further, a pivot hole 14*e* is formed on the frame near the drive roller of the intermediate transfer portion 1 on the front side of the belt cover 20. Similarly, the pivot hole 14*e* is also formed on the rear side of the frame 14. Next, the moving mechanism of the belt cover 20 will be described in detail.

In a similar way described in the first exemplary embodiment, the belt cover 20 is movably supported so as to approach the intermediate transfer belt 106 when the intermediate transfer portion 1 is separated from the photosensitive drums 101. The movement direction when the intermediate transfer portion 1 contacts or separates from the photosensitive drums 101 has a direction component in the direction that the belt cover 20 is moving.

Further, the belt cover 20 of the present exemplary embodiment also has the function of the electric potential regulator 21 in the first exemplary embodiment. In the first exemplary embodiment, the electric potential regulator 21 must be fixed at a constant distance facing the intermediate transfer belt 106. However, the belt cover 20 of the present exemplary embodiment is movable, and can maintain a constant distance near the drive roller. The resultant configuration can reduce the occurrence of separating discharge that is suppressed by the electric potential regulator 21 in the first exemplary embodiment.

The moving mechanism of the belt cover 20 of the present exemplary embodiment will now be described in detail. The belt cover 20 is configured so as to rotate by contacting the inclined face 2*a* of the outside upper portion as the contact portion of the conveyance unit 2. On a right edge of the belt cover 20, the belt cover 20 is fixed with the pivot hole 14*e* and a pivot pin 20*c* of the frame 14.

The distance from the outer circumference surface of the intermediate transfer belt 106 to the belt cover 20 near the rotation support point is about 3 to 5 mm. Since the belt cover 20 is fitted near the pivot point, a constant position of the belt cover 20 from the outer circumference surface of the intermediate transfer belt 106 can be maintained as with the electric potential regulator 21 of the first exemplary embodiment. Thereby, the belt cover 20 in the present exemplary embodiment can work effectively like the electric potential regulator 21 in the first exemplary embodiment.

Further, on the left edge of the belt cover 20, the belt cover 20 has a guide pin 20*a* which protrudes toward the front side in FIG. 8. Similarly, the belt cover 20 has a guide pin 20*a* which protrudes from the rear side in FIG. 8.

Further, a guide groove 14*f* as a support member is formed on the frame 14 on the front side in FIG. 8. Similarly, a guide groove 14*f* is formed on the frame 14 on the rear side in FIG. 8. As a result, the belt cover 20 is rotatably supported by the guide pin 20*a* of the belt cover 20 fitting into the guide groove 14*f*.

The belt cover 20 can rotate around the pivot pin 20*c* within a movable range of the guide pin 20*a* in the guide groove 14*f*. By rotatably supporting the belt cover 20 in this manner, when the guide pin 20*a* is at a lower edge of the guide groove 14*f*, the distance between the left edge, illustrated in FIG. 8, of the belt cover 20 and the intermediate transfer belt 106 is about 10 to 17 mm. Further, when the guide pin 20*a* is at an upper edge of the guide groove 14*f*, the distance between the left edge, illustrated in FIG. 8, of the belt cover 20 and the intermediate transfer belt 106 is about 3 to 5 mm.

As illustrated in the first exemplary embodiment, the belt cover 20 can move so that the space taken up by the intermediate transfer portion 1 is decreased by bringing the conveyance unit 2 of the color printer body and the belt cover 20 of the intermediate transfer portion 1 into contact with each other.

As illustrated in the first exemplary embodiment, by operating the operation lever 33*b* (retraction unit) in the counter-clockwise direction Q on the paper surface from a state where the photosensitive drums 101 and the intermediate transfer belt 106 are separated from each other, the belt cover 20 that is pushed up by the inclined face 2*a* of the outside upper portion of the conveyance unit 2 rotates around the pivot pin 20*c*.

As a result, the guide pin 20*a* abuts the lower surface of the guide groove 14*f* of the frame. At this stage, the distance between the intermediate transfer belt 106 and the left edge surface of the belt cover 20 is about 10 to 17 mm. Thus, in the present exemplary embodiment, the moving unit for moving the protective cover includes a mechanism that rotatably supports the protective cover and the conveyance unit 2 having a contact portion. Further, the contact portion configuring the moving unit is not limited to that located in the conveyance unit 2. For example, the protective cover may be moved by bringing a fixing device into contact with the protective cover.

As illustrated in the first exemplary embodiment, by operating the operation lever 33*b* in the clockwise direction R on the paper surface from a state where the photosensitive drums 101 and the intermediate transfer belt 106 are in contact with each other, the belt cover 20 rotates around the pivot pin 20*c*. As a result, the guide pin 20*a* moves from a state of abutting the lower edge of the guide groove 14*f* of the frame to a state of being near the upper edge of the guide groove 14*f*.

At this stage, by abutting the belt cover 20 with the inclined face 2*a* of the outside upper portion of the conveyance unit 2, the belt cover 20 is comparatively raised with respect to the frame. At this stage, the distance between the belt cover 20 and the intermediate transfer belt 106 is about 3 to 5 mm across the whole belt cover 20.

By thus configuring the intermediate transfer portion 1, like in the first exemplary embodiment, the position of the conveyance unit 2 can be disposed closer to the intermediate transfer portion 1 than the position of the conventional conveyance unit. As a result, the color printer body can be made more compact.

The present exemplary embodiment is preferable in some respects than the first exemplary embodiment, since the number of parts is fewer and the configuration is simpler. However, in a state where the photosensitive drums 101 and the intermediate transfer belt 106 are in contact with each other, the intermediate transfer portion 1 takes up more space than the intermediate transfer portion 1 of the first exemplary embodiment. Regarding this point, the first exemplary embodiment is preferable.

The first exemplary embodiment is characterized by arranging the belt cover 20 for protecting the intermediate transfer belt so as to move parallel to the intermediate transfer belt. A third exemplary embodiment is characterized by having a sheet-like belt cover 20, and an urging member that urges the sheet-like belt cover 20 in a stretching direction.

Although the mechanism which movably supports the belt cover is different from the first exemplary embodiment, like in the first exemplary embodiment, the space that is taken up by the intermediate transfer portion 1 can be decreased compared with the intermediate transfer portion 1 that is immovably fixed to the belt cover 20. Further, parts that are similar to those in the first exemplary embodiment are denoted with the same reference numerals, and thus a description thereof is omitted.

Except for the intermediate transfer portion and the guide pin regulating member T of the color printer body, the apparatus configuration is similar to that in the first exemplary embodiment. Thus, a description of the similarly configured parts is omitted.

Figure 9:
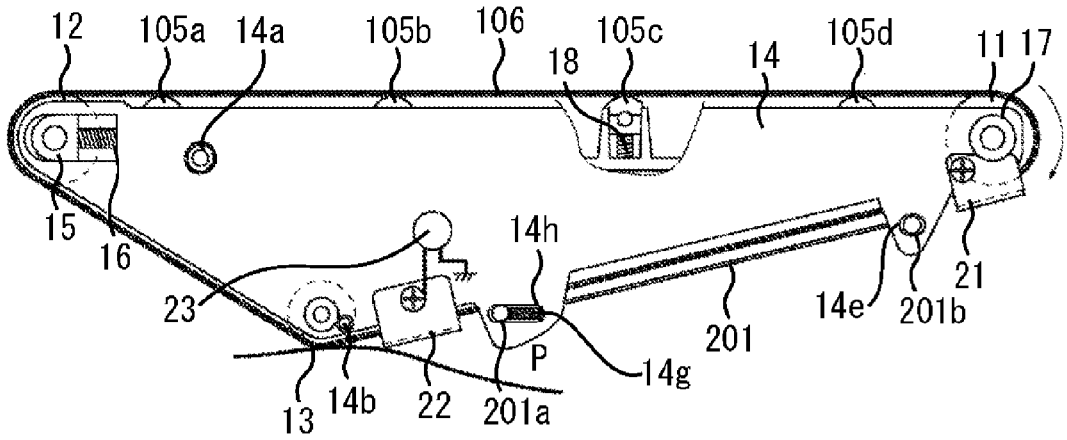
FIG. 9 illustrates a an example of schematic configuration of the intermediate transfer portion housed in the color printer body according to a third exemplary embodiment of the present invention.

FIG. 9 illustrates an intermediate transfer portion of a third exemplary embodiment. As with the first exemplary embodiment, the cover of the intermediate transfer belt 106 of the present exemplary embodiment is divided into three parts. Further, in the present exemplary embodiment, while the intermediate transfer portion also has the electric potential regulator 21 and the pre-transfer guide 22, since these parts are similar to those in the first exemplary embodiment, a description thereof is omitted.

The cover of the intermediate transfer belt 106, which has a different configuration to that of the first exemplary embodiment, will now be described. In the present exemplary embodiment, a guide pin 201*a* of a belt cover 201 is urged by a spring 14*h* in the left direction on the paper surface in FIG. 9, which is a direction that stretches the belt cover 201. As a result, the belt cover 201 is stretched approximately parallel to the intermediate transfer belt 106 by the urging force. Next, the moving mechanism of the belt cover 201 will be described in detail.

The belt cover 201 is arranged so that when the intermediate transfer portion 1 is separated from the photosensitive drums 101, the belt cover 201 is approximately parallel with the intermediate transfer belt 106, while when the intermediate transfer portion 1 and the photosensitive drums 101 are in contact with each other, the belt cover 201 has some slack. The moving mechanism will now be described in detail.

The sheet-like belt cover 201 has the guide pin 201*a* on the left edge in FIG. 9 of the belt cover 201. On the other hand, the frame of the intermediate transfer portion 1 is provided with a guide groove 14*g* (support unit). Further, a spring 14*h* for urging the belt cover 201 in the direction that stretches the belt cover 201 is arranged between the guide groove 14*g* of the frame and the guide pin 201*a* of the belt cover 201. As a result, the guide pin 201*a* of the belt cover 201 fits into the guide groove 14*g* of the frame so that it is urged by the spring 14*h* in the direction that stretches the belt cover 201.

Further, as illustrated in FIG. 9, the belt cover 201 has a fixing pin 201*b* on the right edge of the belt cover 201. Further, the frame has a pivot hole 14*e*, which rotatably supports the fixing pin 201*b*.

When the guide pin 201*a* is in contact with the left edge face of the guide groove 14*g*, the distance between the roughly flat surface formed by the belt cover 201 and the intermediate transfer belt 106 is about 3 to 5 mm. Further, when the guide pin 201*a* is near the right edge face of the guide groove 14*g*, the belt cover 201 hangs down by its own weight. At this stage, the distance between the portion of the belt cover 201 that is hanging down the most in the direction of gravity and the intermediate transfer belt 106 is about 10 to 15 mm.

Figure 11A:
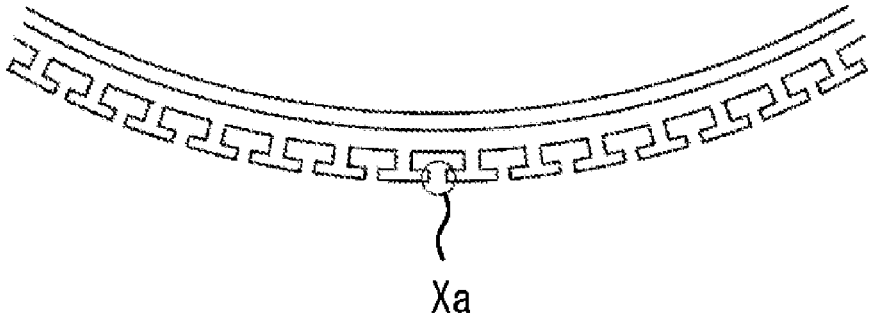
FIGS. 11A to 11C each illustrate an example of a cross sectional shape of a belt cover according to the third exemplary embodiment of the present invention.
Figure 11B:
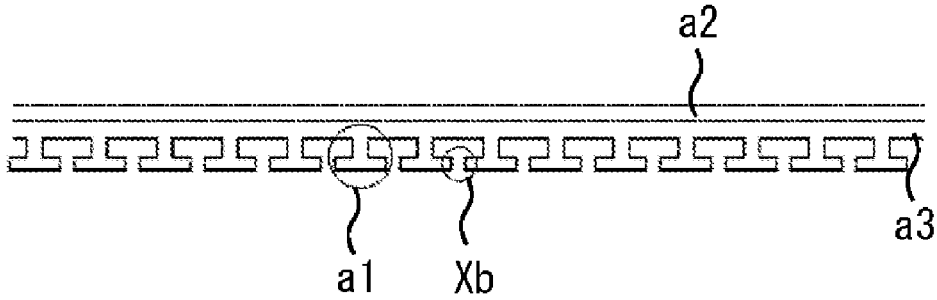
Figure 11C:
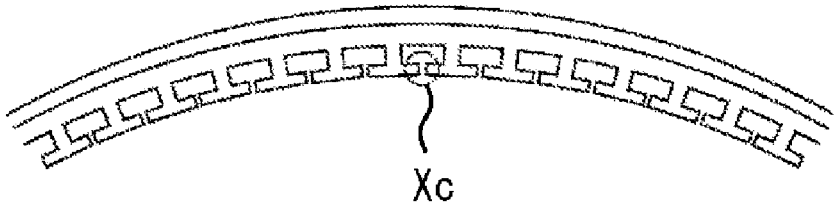

Further, it is desirable that the belt cover 201 is configured by a member having a different resistance based on bending directions, an example of which is illustrated in FIGS. 11A, 11B, and 11C. A substrate a2 is a sheet-like conductor. Further, the substrate a2 is integrally formed with a resistance layer a3 that causes the difference of bending resistance according to a bending direction. The resistance layer a3 is a layer having a roughly T-shaped protrusion a1 in the lower side on the paper surface in FIGS. 11A, 11B, and 11C.

As illustrated by in FIG. 11A, when the substrate a2 is bent in a downward direction illustrated in FIG. 11A, a space Xa between adjacent roughly T-shapes of the resistance layer a3 becomes wider than a space Xb illustrated in FIG. 11B. In contrast, as illustrated in FIG. 11C, when the substrate a2 is bent in an upward direction illustrated in FIGS. 11A, 11B, and 11C, a space Xc between adjacent roughly T-shapes of the resistance layer becomes narrower than the space Xb.

In the state illustrated in FIG. 11C, adjacent roughly T-shaped portions of the resistance layer are in contact with each other. Thus, a sheet having a configuration like that illustrated in FIGS. 11A, 11B, and 11C has a different bending resistance depending on the bending direction. Therefore, by utilizing a sheet having such a configuration for the belt cover 201, contact between the belt cover 201 and the intermediate transfer belt 106 can be suppressed.

Figure 10A:
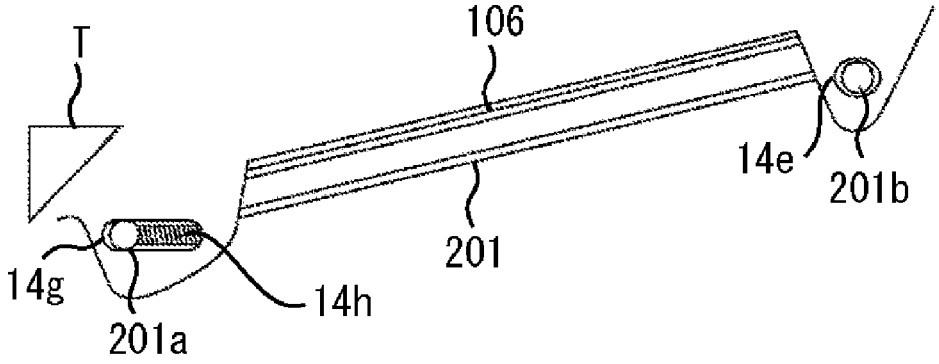
FIGS. 10A and 10B each illustrate an example of a state of a belt cover according to the third exemplary embodiment of the present invention.
Figure 10B:
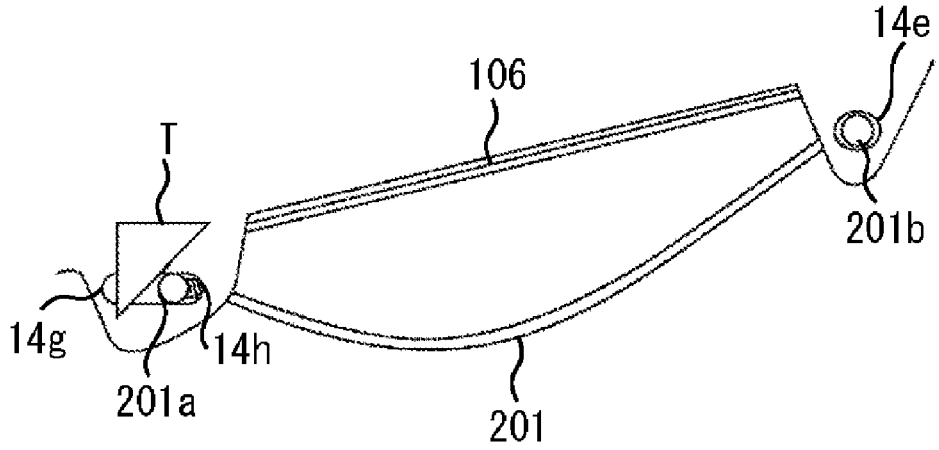

In the present exemplary embodiment, the color printer body has a guide pin regulating member T like that illustrated in FIGS. 10A and 10B as a contact portion. By having such a configuration, the necessary distance between the belt cover 201 and the intermediate transfer belt 106 during image forming can be sufficiently maintained, and the belt cover 201 can be moved so that the space that is taken up by the intermediate transfer portion 1 when the intermediate transfer portion 1 is retracted is decreased.

By operating the operation lever 33*b* in the counterclockwise direction Q on the paper surface when the photosensitive drums 101 and the intermediate transfer belt 106 are separated from each other, the belt cover 201 changes from the state illustrated in FIG. 10A to the state illustrated by in FIG. 10B. In the state illustrated in FIG. 10B, the guide pin 201*a* moves near the right edge of the guide groove 14*g* by the guide pin regulating member T of the color printer body.

As a result, the belt cover 201 hangs down due to its own weight. At this stage, the distance between the portion of the belt cover 201 that is hanging down the most in the direction of gravity and the intermediate transfer belt 106 is about 10 to 15 mm. Thus, a desired distance between the belt cover 201 and the intermediate transfer belt 106 can be maintained during image forming.

By operating the operation lever 33*b* in the clockwise direction R when the photosensitive drums 101 and the intermediate transfer belt 106 are in contact with each other, the belt cover 201 changes from the state illustrated in FIG. 10B to the state illustrated in FIG. 10A.

In the state illustrated in FIG. 10A, the guide pin 201*a* is not regulated by the guide pin regulating member T of the color printer body. Therefore, the guide pin 201*a* receives an urging force by the spring 14*h* and moves to the left edge of the guide groove 14*g*. As a result, the belt cover 201 is stretched by the spring 14*h*.

At this stage, the distance between the roughly flat surface formed by the belt cover 201 and the intermediate transfer belt 106 is about 3 to 5 mm. By thus configuring the intermediate transfer portion 1 and the color printer body, like in the first exemplary embodiment, the position of the conveyance unit 2 can be arranged closer to the intermediate transfer portion 1 than that of the conventional conveyance unit.

A fourth exemplary embodiment is characterized by having a positional relationship of the respective units in the color printer that is different from that of the first exemplary embodiment. That is, the photosensitive drums 101 are arranged in the lower position of the intermediate transfer portion. Parts that are similar to those in the first exemplary embodiment are denoted with the same reference numerals, and thus a description thereof is omitted. The parts that are different from those in the first exemplary embodiment will now be described. In addition, in the present configuration, when the intermediate transfer portion is in a retracted position from the photosensitive drums 101, the protective cover approaches the intermediate transfer belt caused by its own weight.

The positional relationship in the present exemplary embodiment between the intermediate transfer portion and the other units will now be described.

Figure 12:
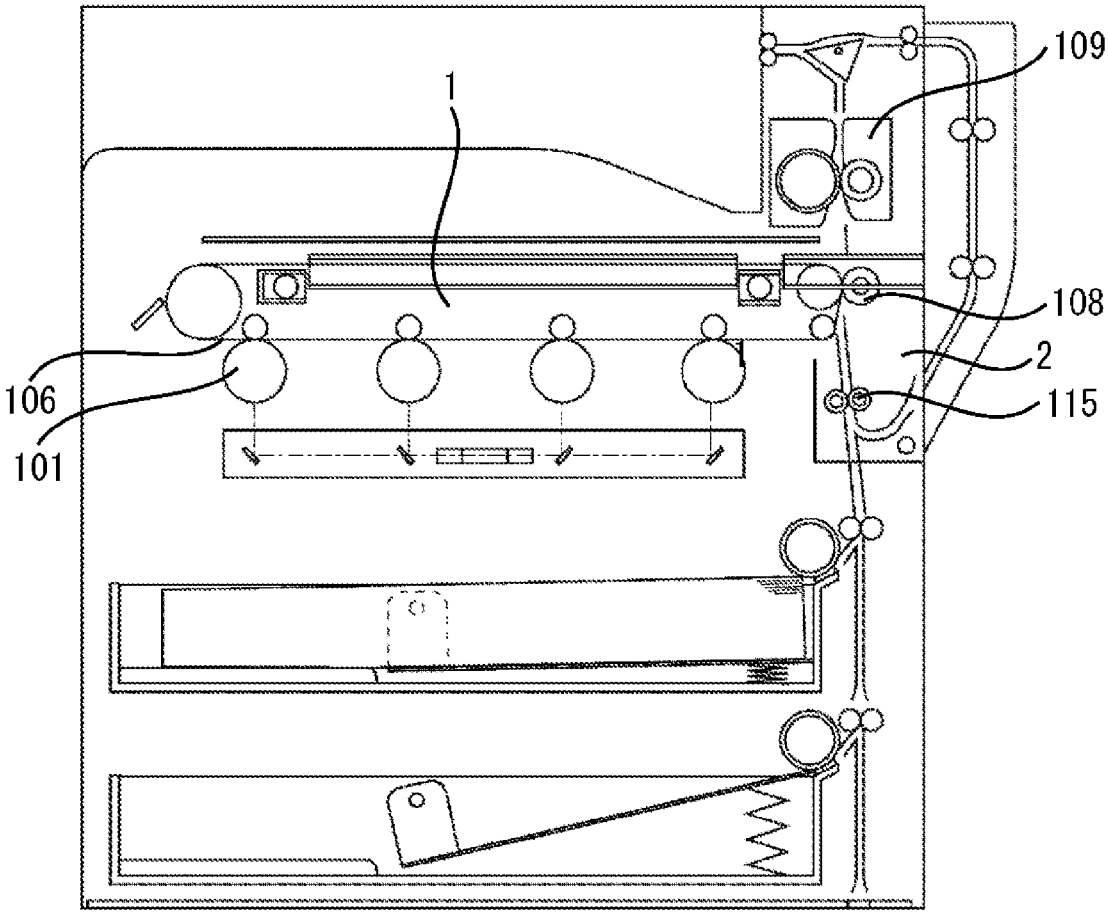
FIG. 12 illustrates an example of a schematic configuration of the intermediate transfer portion housed in the color printer body according to a fourth exemplary embodiment of the present invention.

FIG. 12 illustrates a color printer body in the present exemplary embodiment. In the present exemplary embodiment, photosensitive drums 101 are arranged in a lower position of the intermediate transfer portion 1. Further, the conveyance unit 2 of the recording material is arranged on the right side of the intermediate transfer portion 1, and the fixing device is arranged on the upper right side on the paper surface. The image forming process in the present exemplary embodiment is the similar to that in the first exemplary embodiment.

Figure 13:
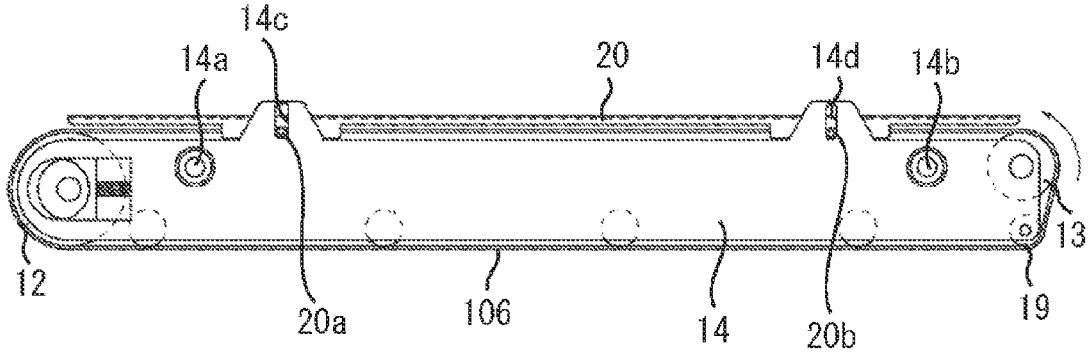
FIG. 13 illustrates an example of a schematic configuration of the intermediate transfer portion housed in the color printer body according to the fourth exemplary embodiment of the present invention.

FIG. 13 illustrates the intermediate transfer portion 1. The intermediate transfer belt 106 is stretched around by three stretching rollers (a secondary transfer inner roller 13, a tension roller 12, and a drive roller 11) all of which are supported on the frame 14. Here, the drive roller 11 rotates by receiving a driving force from the body. Further, by rotating the drive roller 11 in an counterclockwise direction, the intermediate transfer belt 106 rotates in an counterclockwise direction.

The intermediate transfer portion 1 has two bosses 14*a* and 14*b* protruding toward the front side in FIG. 13. Similarly, two bosses protrude from the rear side of the frame. The intermediate transfer portion 1 is positioned on the color printer body using these four bosses as a reference.

In the unit arrangement of the present exemplary embodiment, a belt cover 20 is provided to protect the intermediate transfer belt 106 when the intermediate transfer portion 1 is out of the apparatus. Guide pins 20*a* and 20*b* are arranged on the belt cover 20 serving as the protective cover so as to protrude toward the front side in FIG. 13. Similarly, the guide pins 20*a* and 20*b* are arranged so as to protrude from the rear side on the paper surface of the belt cover.

On the frame 14, guide grooves 14*c* and 14*d* corresponding to the guide pins 20*a* and 20*b* are provided on the front side in FIG. 13. Similarly, guide grooves 14*c* and 14*d* are provided on the rear side of the frame. As a result, the guide pins 20*a* and 20*b* arranged on the belt cover 20 fit into the guide grooves arranged on the frame, so that the belt cover 20 can move along the guide grooves 14*c* and 14*d*.

When the guide pins 20*a* and 20*b* of the belt cover 20 are positioned near the upper edge of the guide grooves 14*c* and 14*d*, the distance between the intermediate transfer belt 106 and the belt cover 20 is about 8 to 15 mm. This is a distance where the intermediate transfer belt 106 and the belt cover 20 do not rub against each other even considering the slack, which is generated during rotation of the intermediate transfer belt 106, and the amount that the intermediate transfer belt 106 is moved caused by its electric charge while image formation is performed.

On the other hand, when the guide pins 20*a* and 20*b* of the belt cover 20 are at a lower edge position of the guide grooves 14*c* and 14*d*, the distance between the intermediate transfer belt 106 and the belt cover 20 is about 3 to 5 mm. This is a distance where the intermediate transfer belt 106 and the belt cover 20 do not contact each other when the intermediate transfer belt 106 is not rotating, that is, when considering only the parts tolerance in a state where an image is not being formed. Here, the belt cover 20 is arranged so that it can be easily moved without being urged by a spring in a movable direction thereof.

When replacing the intermediate transfer portion 1, the intermediate transfer portion 1 is separated not to damage the photosensitive drums 101 and the intermediate transfer belt surface. This action will now be described while comparing the intermediate transfer portion mechanisms illustrated in FIGS. 14 and 15, in which the belt cover moves so that the space taken up by the intermediate transfer portion 1 is decreased.

A rail 31 for guiding the intermediate transfer portion 1 is arranged on the color printer body. Further, a pressure member 35 that moves up and down according to the operation of a pressure lever (not illustrated) is arranged on a part of the rail 31. When the intermediate transfer portion 1 enters as far as a predetermined set position, the boss 14*a* of the frame fits into the pressure member 35. As a result, the boss 14*a* is guided along the rail 31 of the color printer body to position the intermediate transfer portion 1 in the color printer body.

Further, by moving the pressure member 35 up and down in response to the operation of the pressure lever, the distance between the belt cover 20 and the intermediate transfer belt 106 changes. As a result, since the boss 14*a* is held by the pressure member 35 of the color printer body, the intermediate transfer portion 1 can be contacted with and separated from the photosensitive drums 101.

Further, the belt cover itself is supported at the upper portion of the rail 31 of the color printer body, and is not urged by a spring in a movable direction thereof.

Figure 14:
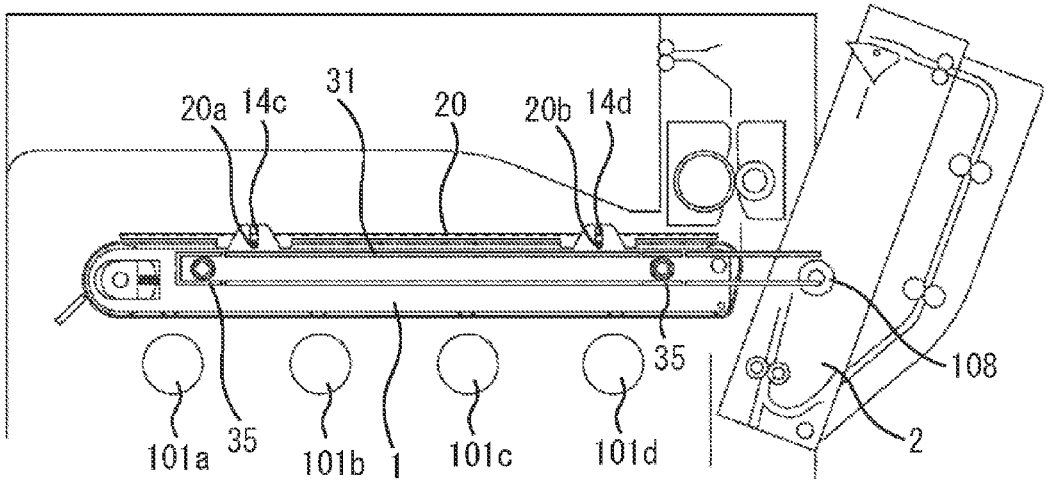
FIG. 14 illustrates an example of a state in which the intermediate transfer portion and the photosensitive drums are separated according to the fourth exemplary embodiment of the present invention.
Figure 15:
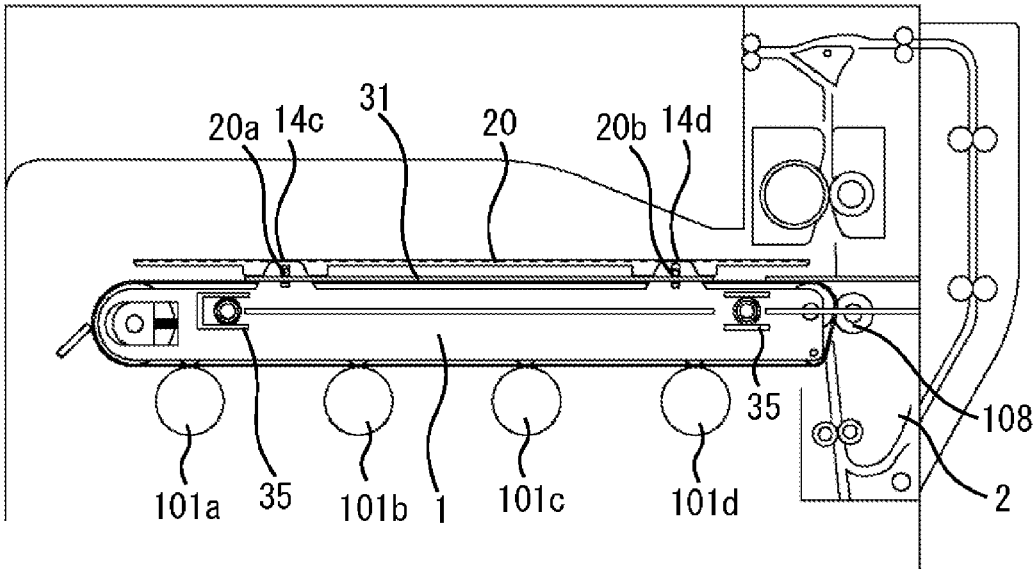
FIG. 15 illustrates an example of a state in which the intermediate transfer portion and the photosensitive drums are pressed according to the fourth exemplary embodiment of the present invention.

FIG. 14 illustrates a state where the intermediate transfer portion 1 is separated from the photosensitive drums 101. Further, FIG. 15 illustrates a state where the intermediate transfer portion 1 is in contact with the photosensitive drums 101. The intermediate transfer portion 1 is either in the state illustrated in FIG. 14 or in the state illustrated in FIG. 15 as a result of the user's operation of the pressure lever of the color printer body.

FIG. 15 illustrates a state where the intermediate transfer portion 1 is in contact with the photosensitive drums 101, and an image can be formed. In the state illustrated in FIG. 15, the distance between the intermediate transfer belt 106 and the belt cover 20 is about 8 to 15 mm. The configuration for moving the belt cover will now be described.

By operating the pressure lever in the state illustrated in FIG. 14, the pressure member 35 becomes in the state illustrated in FIG. 15. At this stage, the intermediate transfer portion 1 moves downward together with the pressure member 35. However, the guide pins 20*a* and 20*b* of the belt cover 20 abut the upper portion of the rail 31 midway along.

As a result, the guide pins 20*a* and 20*b* supported on the upper face of the rail 31 abut the upper portion of the guide grooves 14*c* and 14*d* arranged on the frame, so that the distance from the intermediate transfer belt 106 comparatively widens. As a result, the guide pins 20*a* and 20*b* contact the upper edge face of the guide grooves 14*c* and 14*d*, and the distance between the intermediate transfer belt 106 and the belt cover becomes about 8 to 15 mm.

FIG. 14 illustrates a state where the intermediate transfer portion 1 is separated from the photosensitive drums 101. In the state illustrated in FIG. 15, the distance between the intermediate transfer belt 106 and the belt cover 20 is about 3 to 5 mm. The configuration for moving the belt cover 20 will now be described.

By operating the pressure lever in the state illustrated in FIG. 15, the pressure member 35 is changed in the state illustrated in FIG. 14. As a result, the intermediate transfer portion 1 moves in the upper direction on the paper surface, and the guide pins 20*a* and 20*b* supported on the upper face of the rail 31 move upward to be supported by lower edges of the guide grooves 14*c* and 14*d*. The distance between the intermediate transfer belt 106 and the belt cover 20 at that stage is about 3 to 5 mm.

By thus configuring the intermediate transfer portion 1, as in the first exemplary embodiment, the space taken up by the intermediate transfer portion 1 can be decreased. Therefore, the position of the other units, such as the fixing device, arranged in an upper direction on the paper surface can be arranged closer to the intermediate transfer portion 1 than those of the conventional units. As a result, the color printer body can be made more compact.

Figure 16:
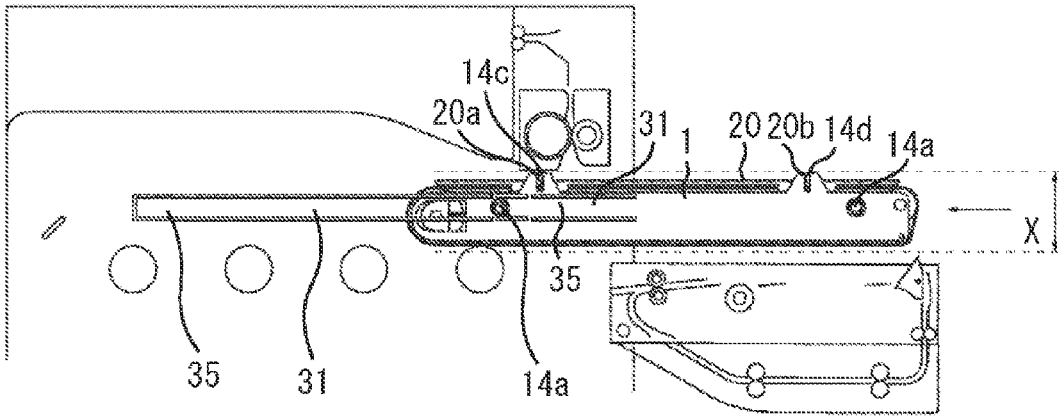
FIG. 16 illustrates an example of a positional relationship between the intermediate transfer portion and the color printer body according to the fourth exemplary embodiment of the present invention.

As illustrated in FIG. 16, the intermediate transfer portion 1 is arranged so as to be detachable when replacing it. At this stage, the belt cover 20 abuts the lower face of the guide grooves 14*c* and 14*d* of the frame by its own weight.

At this stage, the distance between the intermediate transfer belt 106 and the belt cover 20 is about 3 to 5 mm. Thus, the aperture X when detaching or inserting the intermediate transfer portion 1 can be made narrower than when the belt cover is immovably fixed to the frame. By making the aperture X narrower, the rigidity of the printer body can be improved.

Here, although the materials for the pre-transfer guide 22, the electric potential regulator 21, and the belt cover 20 are specifically described, the present invention is not limited to these materials. Further, while the distances between the belt cover 20 and the intermediate transfer belt 106 is specifically described, the present invention is obviously not limited to such distances.

In all of the above-described exemplary embodiments, similar advantageous effects can also be obtained with a configuration in which bosses are provided instead of the guide grooves of the frame, and guide grooves are provided instead of the bosses of the belt cover. Further, similar advantageous effects can also be obtained if a rack is provided instead of the guide grooves of the frame, and a gear is provided instead of the bosses of the belt cover. Still further, the similar advantageous effects can also be obtained if gears are provided instead of the guide grooves of the frame, and racks are provided instead of the bosses of the belt cover.

Further, the belt cover can be moved by receiving with the gear a drive force from the motor directly or indirectly. Further, in the exemplary embodiments, while a color printer is used as an example, a monochrome printer can also be used.

In the first, second, and fourth exemplary embodiments, the bosses of the belt cover are not urged by a spring. However, when the intermediate transfer portion is retracted from the photosensitive drums, as long as the belt cover approaches the intermediate transfer belt, the bosses of the belt cover can also be urged by a spring.

Further, the image conveyance member is not limited to an intermediate transfer member, and it can be a photosensitive member. In this case, the image forming device is formed with the charging device and the developing unit. In this case the photosensitive unit includes a protective cover to protect the surface of the photosensitive member. In such a photosensitive unit, the protective cover approaches the photosensitive member as the photosensitive member retracts from the charging device and the developing unit.

Further, although the first to fourth exemplary embodiments have been described using an intermediate transfer belt as an example, the present invention can also be applied to other units with a similar configuration. For example, the present invention can be applied to a recording material carrier unit including a protective cover for protecting an electrostatic image transfer belt as a recording material carrier and the surface of the electrostatic image transfer belt.

A transfer portion is formed between the electrostatic image transfer belt and the photosensitive drums serving as the image forming device. The electrostatic image transfer belt supports on the belt surface a recording material fed from a cassette and conveys the recording material to the transfer portion. A toner image formed on the photosensitive drums is transferred onto the recording material supported on the electrostatic image transfer belt at the transfer portion.

Like with the intermediate transfer portion, even in such a configuration it is preferred to prevent rubbing between the photosensitive drums and the electrostatic image transfer belt. Therefore, in the configuration in which the recording material carrier unit is retracted from the photosensitive drums, the protective cover for protecting the electrostatic image transfer belt is supported by a support mechanism so as to approach the electrostatic image transfer belt. Even in such a configuration, the size of the color printer can be made more compact.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-149369 filed Jun. 6, 2008, which is hereby incorporated by reference herein in its entirety.

What is claimed is:

1. An image forming apparatus comprising:

an image forming device configured to form a toner image; and an image conveyance unit configured to be moved between an image forming position where the toner image formed by the image forming device is transferred to a recording material and a retracting position retracted from the image forming device, which is different from the image forming position, and configured to be removable from the image forming apparatus, wherein the image conveyance unit includes:

an image conveyance member configured to convey a toner image formed by the image forming device to a transfer portion which transfers the toner image onto a recording material;

a protective cover configured to protect a surface of the image conveyance member on which the toner image is formed;

a supporting portion configured to movably support the protective cover so that the protective cover approaches the image conveyance member when the image conveyance unit retracts from the image forming position to the retracting position, wherein the protective cover is supported by the supporting portion without being urged in a direction away from the image conveyance member and grounded; and a guide cover adjacent to the protective cover, fixed so that a distance from the image conveyance member does not change even when the image conveyance unit is retracted from the image forming device, configured to protect a surface of the image conveyance member on which the toner image is formed, grounded via a varistor, and configured to guide the recording material to a transfer portion.

2. The image forming apparatus according to claim 1, wherein at the retracting position the image conveyance unit can be removed from the image forming apparatus.

3. The image forming apparatus according to claim 1, wherein the supporting portion is configured to movably support the protective cover so that the protective cover separates from the image conveyance member when the image conveyance unit contacts the image forming device.

4. The image forming apparatus according to claim 1, wherein the image conveyance member is formed in a belt-like shape, and wherein the image conveyance unit includes:

a plurality of stretching rollers stretching the belt-like image conveyance member; and a facing cover arranged adjacent to the protective cover so as to face the stretching rollers and to protect a surface of the image conveyance member on which the toner image is formed, wherein the protective cover is supported by the supporting portion without being urged in a direction away from the belt-like image conveyance member, and is grounded, and wherein the facing cover is fixed so that a distance from the belt-like image conveyance member does not change even when the image conveyance unit is retracted from the image forming device, and is grounded.

5. An intermediate transfer unit comprising:

an intermediate transfer member configured to transfer onto a recording material a toner image that is transferred from a photosensitive member;

a protective cover configured to protect a surface of the intermediate transfer member on which the toner image is transferred;

a supporting portion configured to movably support the protective cover so that the protective cover approaches the intermediate transfer member when the intermediate transfer portion retracts from the photosensitive member, wherein the protective cover is supported by the supporting portion without being urged in a direction away from the intermediate transfer member and grounded; and a guiding cover adjacent to the protective cover, fixed so that a distance from the intermediate transfer member does not change even when the intermediate transfer member is retracted from the photosensitive member, configured to protect a surface of the intermediate transfer member on which the toner image is transferred, grounded via a varistor, and configured to guide the recording material to a transfer portion.

6. The intermediate transfer unit according to claim 5, wherein the supporting portion is configured to movably support the protective cover so that the protective cover separates from the intermediate transfer member when the intermediate transfer member contacts the photosensitive member.

7. The intermediate transfer portion according to claim 5, wherein the intermediate transfer member is formed in a belt-like shape, and the intermediate transfer portion includes:

a plurality of stretching rollers stretching the belt-like intermediate transfer member; and a facing cover arranged adjacent to the protective cover so as to face the stretching rollers, and which protects a surface of the intermediate transfer member on which the toner image is formed, wherein the protective cover is supported by the support unit without being urged in a direction away from the belt-like intermediate transfer member, and is grounded, and wherein the facing cover is fixed so that a distance from the belt-like intermediate transfer member does not change even when the intermediate transfer portion is retracted from the image forming device, and is grounded.

8. An image forming apparatus comprising:

an image carrier;

an image forming device configured to form a toner image on the image carrier;

an image conveyance unit including a belt configured to convey a toner image formed on the image carrier to a transfer portion which transfers the toner image onto a recording material, and a protective cover configured to protect a surface of the belt on which the toner image is formed;

a mechanism configured to retract the image conveyance unit from the image carrier to a position from which the image conveyance unit can be removed from the image forming apparatus; and a support unit configured to movably support the protective cover so that the protective cover approaches the belt by a force that the image conveyance unit received by contacting other unit when the image conveyance unit is retracted from the image carrier by the mechanism.

9. The image forming apparatus according to claim 8, wherein the other unit that contacts the image conveyance unit is a conveyance unit configured to convey a recording material.

10. The image forming apparatus according to claim 8, wherein the other unit that contacts the image conveyance unit is a fixing unit configured to fix a toner image transferred onto a recording material.

11. An image forming apparatus comprising:

an image carrier;

an image forming unit configured to form a toner image on the image carrier;

an image conveyance unit including a belt configured to convey a toner image formed on the image carrier to a transfer portion that transfers the toner image onto a recording material, and a protective cover configured to protect a surface of the belt on which the toner image is formed;

a mechanism configured to move the image conveyance unit from a position where the image conveyance unit can be removed from the image forming apparatus to a position where the image carrier contacts the belt; and a support unit configured to movably support the protective cover so that the belt and the protective cover move away from each other toward a space at a position where the image conveyance unit can be removed from the image forming apparatus, when the mechanism moves the belt of the image conveyance unit to a position where the belt contacts the image carrier.

12. The image forming apparatus according to claim 11, wherein the image conveyance unit receives a force by contacting other unit when the image conveyance unit is at a position where the image conveyance unit can be removed from the image forming apparatus, wherein the support unit supports the protective cover by receiving the force so that a distance between the belt and the protective cover is a first distance, and wherein the image conveyance unit is moved away from other unit as the mechanism moves the image conveyance unit to a position where the belt contacts the image carrier, and thereby, a distance between the belt and the protective cover becomes a second distance that is longer than the first distance.

13. The image forming apparatus according to claim 11, wherein the image conveyance unit is adjacent to the protective cover, is fixed so that a distance from the belt does not change, covers a surface on which a toner image on the belt is conveyed, and includes a guide cover grounded via a varistor and configured to guide a recording material to a transfer portion.

14. An image forming apparatus comprising:

an image forming device configured to form a toner image; and an image conveyance unit configured to be moved between an image forming position where the toner image formed by the image forming device is transferred to a recording material and a retracting position retracted from the image forming device, which is different from the image forming position, and configured to be removable from the image forming apparatus, wherein the image conveyance unit includes:

an image conveyance member configured to convey a toner image formed by the image forming device to a transfer portion which transfers the toner image onto a recording material;

a protective cover configured to protect a surface of the image conveyance member on which the toner image is formed; and a support unit configured to movably support the protective cover so that the protective cover approaches the image conveyance member when the image conveyance unit retracts from the image forming position to the retracting position, wherein at the retracting position the image conveyance unit can be removed from the image forming apparatus, wherein the support unit is configured to movably support the protective cover so that the protective cover separates from the image conveyance member when the image conveyance unit contacts the image forming device, wherein the image conveyance unit comprises a guiding cover configured to protect a surface of the image conveyance member on which the toner image is formed and to guide the recording material to the transfer portion, wherein the protective cover is supported by the support unit without being urged in a direction away from the image conveyance member, and is grounded, and wherein the guiding cover adjacent to the protective cover is fixed so that a distance from the image conveyance member does not change even when the image conveyance unit is retracted from the image forming device, and is grounded via a varistor.

* * * * *